US011746769B2

(12) United States Patent
Mou et al.

(10) Patent No.: US 11,746,769 B2
(45) Date of Patent: Sep. 5, 2023

(54) MINIATURE BLOWER

(71) Applicant: MICROJET TECHNOLOGY CO., LTD., Hsinchu (TW)

(72) Inventors: Hao-Jan Mou, Hsinchu (TW); Jyun-Yi Jhang, Hsinchu (TW); Chun-Lung Tseng, Hsinchu (TW); Jia-Yu Liao, Hsinchu (TW); Shih-Chang Chen, Hsinchu (TW); Yung-Lung Han, Hsinchu (TW); Chi-Feng Huang, Hsinchu (TW); Chun-Yi Kuo, Hsinchu (TW); Yi-Ting Lu, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 267 days.

(21) Appl. No.: 17/097,005

(22) Filed: Nov. 13, 2020

(65) Prior Publication Data

US 2021/0172430 A1 Jun. 10, 2021

(30) Foreign Application Priority Data

Dec. 6, 2019 (TW) ..... 108144820

(51) Int. Cl.

*F04B 43/04* (2006.01)
*F04B 39/00* (2006.01)
*F04B 11/00* (2006.01)

(52) U.S. Cl.

CPC ..... *F04B 43/046* (2013.01); *F04B 11/00* (2013.01); *F04B 39/005* (2013.01); *F04B 39/0027* (2013.01)

(58) Field of Classification Search

CPC ..... F04B 43/046; F04B 43/14; F04B 45/10; F04B 45/04–45/047;

(Continued)

(56) References Cited

U.S. PATENT DOCUMENTS 10,781,810 B2 9/2020 Tanaka et al.
10,871,156 B2 12/2020 Tanaka et al.

(Continued)

FOREIGN PATENT DOCUMENTS

CN 107795465 A 3/2018
CN 109477478 A 3/2019

(Continued)

OTHER PUBLICATIONS

Machine Translation of WIPO document WO 2019221121 A1 to Shimoda retrieved from espacenet on Feb. 22, 2022 (Year: 2022).*

(Continued)

*Primary Examiner* — Philip E Stimpert
*Assistant Examiner* — Dnyanesh G Kasture
(74) *Attorney, Agent, or Firm* — McClure, Qualey & Rodack, LLP

(57) ABSTRACT

A miniature blower includes a soft sheet, a nozzle plate, a chamber frame, an actuator body, an insulation frame, and a conductive frame. The nozzle plate has a suspension portion, and the soft sheet is disposed on the suspension portion. The chamber frame is disposed on the nozzle plate. The actuator body includes a piezoelectric carrier plate, an adjusting resonance plate, and a piezoelectric plate. The actuator body is disposed on the chamber frame. The insulation frame is disposed on the actuator. The center point of a central hole of the soft sheet and the center point of a hollow hole of the suspension portion are located at the same axis.

8 Claims, 7 Drawing Sheets

(58) Field of Classification Search
CPC ..... F04B 43/02–43/028; F04B 43/04; B05B 17/06; B05B 17/0638; B05B 17/0646; B05B 17/0653
USPC ..... 181/207, 208; 381/190, 395; 239/4, 239/102.1, 102.2
See application file for complete search history.

(56) References Cited

U.S. PATENT DOCUMENTS

| | | | | |
|---|---|---|---|---|
| 11,097,544 | B2 * | 8/2021 | Muramatsu | B01L 3/0268 |
| 2003/0143122 | A1 * | 7/2003 | Sander | F16K 99/0001 422/503 |
| 2006/0292023 | A1 * | 12/2006 | Kim | F04B 39/0027 417/572 |
| 2007/0051827 | A1 * | 3/2007 | Shen | B05B 17/0646 239/548 |
| 2009/0196778 | A1 * | 8/2009 | Kitahara | F04B 11/0016 417/540 |
| 2013/0071269 | A1 * | 3/2013 | Fujisaki | F04B 43/046 417/413.2 |
| 2016/0169179 | A1 * | 6/2016 | Noguchi | F02M 61/162 239/518 |
| 2016/0310769 | A1 * | 10/2016 | Tang | A61M 16/206 |
| 2017/0058882 | A1 * | 3/2017 | Hirata | F04B 43/046 |
| 2017/0152845 | A1 * | 6/2017 | Sasaki | F04D 33/00 |
| 2018/0297053 | A1 * | 10/2018 | Buckland | B05B 17/0638 |
| 2021/0038775 | A1 * | 2/2021 | Locke | A61M 1/90 |

FOREIGN PATENT DOCUMENTS

| | | | | |
|---|---|---|---|---|
| CN | 109642681 | A | 4/2019 | |
| JP | 2016113953 | A * | 6/2016 | F04B 45/04 |
| JP | 2016211442 | A | 12/2016 | |
| JP | WO 2019221121 | A1 * | 11/2019 | F04B 45/047 |
| TW | M558350 | U | 4/2018 | |

OTHER PUBLICATIONS

Machine Translation of JP 2016113953 A to Sasaki retrieved from espacenet on Mar. 8, 2022 (Year: 2022).*

* cited by examiner

MINIATURE BLOWER

CROSS-REFERENCE TO RELATED APPLICATION

This non-provisional application claims priority under 35 U.S.C. § 119(a) to Patent Application No. 108144820 filed in Taiwan, R.O.C. on Dec. 6, 2019, the entire contents of which are hereby incorporated by reference.

BACKGROUND

Technical Field

The present disclosure relates to a miniature blower. In particular, to a thin, portable, and low noise miniature blower.

Related Art

Many blowers discharge out gas by vibration of components in the blowers during their operation process. Because of the rapid high-frequency vibration, the operation of this type of blowers is often accompanied by the noise of the air flow. Thus, due to noise caused by the physical phenomena, such blowers cannot achieve the purpose of being portable as well as quiet and comfortable.

SUMMARY

In general, one of the objects of present disclosure is to provide a miniature blower which can reduce the noise caused by the air flow generated by its operation. The miniature blower of the present disclosure may become much more silent.

To achieve the above mentioned purpose(s), a general embodiment of the present disclosure provides a miniature blower including a soft sheet, a nozzle plate, a chamber frame, an actuator body, an insulation frame, a conductive frame. The soft sheet has a central hole. The nozzle plate has a suspension portion disposed on the soft sheet, and the suspension portion has a hollow hole and is capable of bending and vibrating. A center point of the central hole of the soft sheet and a center point of the hollow hole of the suspension portion are on a same axis. The chamber frame is disposed on the nozzle plate. The actuator body is formed by sequentially stacking, from bottom to top, a piezoelectric carrier plate, an adjusting resonance plate, and a piezoelectric plate with each other. The actuator body is disposed on the chamber frame, and the piezoelectric carrier plate is used to be applied with a first voltage and a second voltage so as to drive the piezoelectric plate to bend and vibrate reciprocatingly. The first voltage and the second voltage are alternately applied to the piezoelectric carrier plate at a frequency. The insulation frame is disposed on the actuator body. The conductive frame is disposed on the insulation frame. When the piezoelectric carrier plate is applied with the first voltage and the conductive frame is applied with the second voltage, the piezoelectric plate bends and vibrates toward a first direction. When the piezoelectric carrier plate is applied with the second voltage and the conductive frame is applied with the first voltage, the piezoelectric plate bends and vibrates toward a second direction opposite to the first direction. A resonance chamber is formed among the actuator body, the chamber frame, and the suspension portion. Upon application of the first voltage and the second voltage alternately, the actuator body is driven and thus brings the nozzle plate to resonate, so that the suspension portion of the nozzle plate bends and vibrates reciprocatingly. Thus, the gas passes through the central hole of the soft sheet and the hollow hole of the suspension portion to the resonance chamber and then is discharged out, thereby achieving gas transmission.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
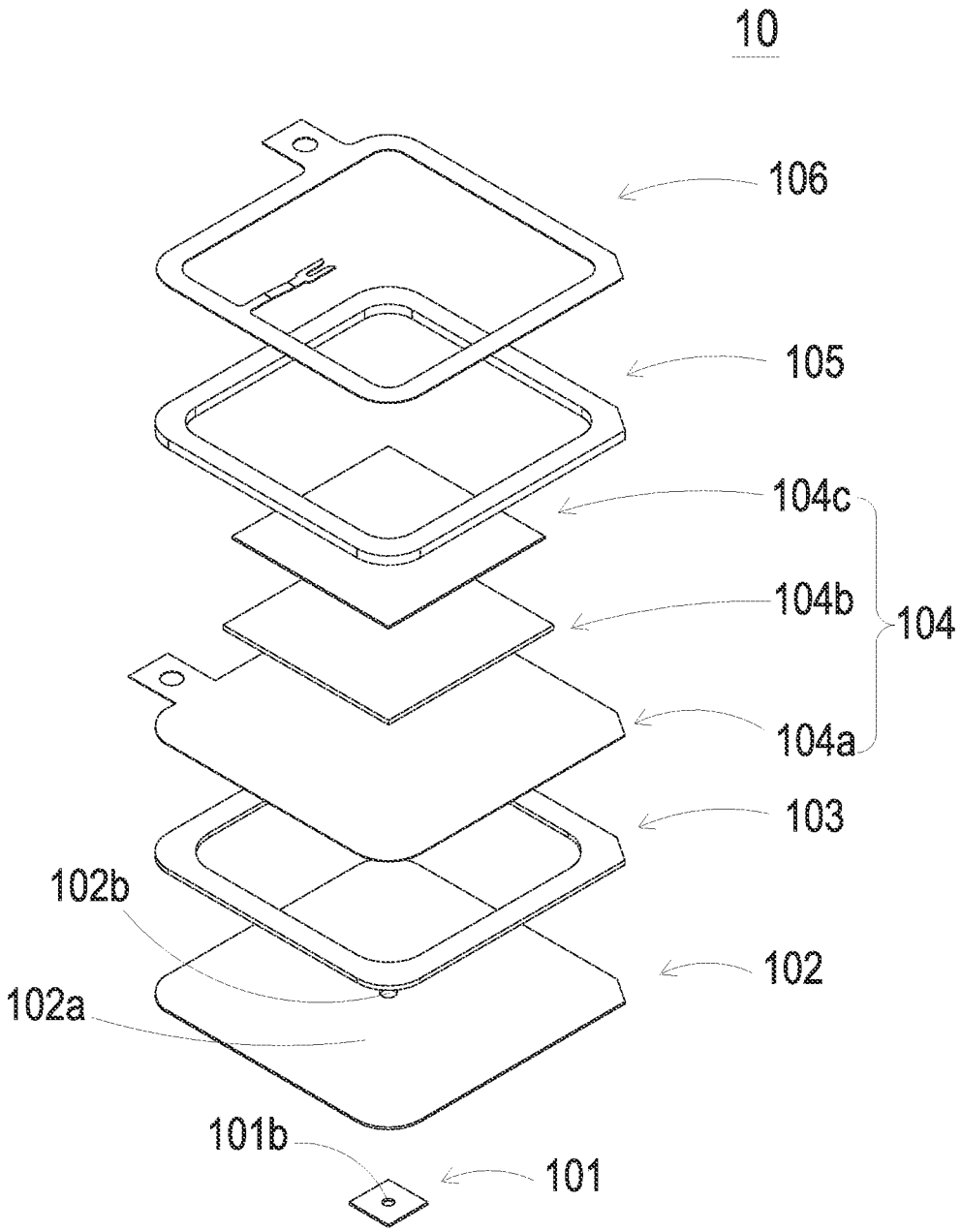
FIG. 1 illustrates a schematic exploded view of a miniature blower according to an exemplary embodiment of the present disclosure.

The present disclosure will now be described more specifically with reference to the following embodiments. It is to be noted that the following descriptions of different embodiments of this disclosure are presented herein for purpose of illustration and description only, and it is not intended to limit the scope of the present disclosure.

Please refer to FIG. 1 to FIG. 3A. The present disclosure provides a miniature blower 10, which includes a soft sheet 101, a nozzle plate 102, a chamber frame 103, an actuator body 104, an insulation frame 105, and a conductive frame 106. The soft sheet 101 is a thin noise-absorbing pad. The center portion of the soft sheet 101 has a central hole 101*b*. The nozzle plate 102 has a suspension portion 102*a*, and the soft sheet 101 is disposed on the nozzle plate 102. The center portion of the suspension portion 102*a* has a hollow hole 102*b*, and the suspension portion 102*a* is capable of bending and vibrating. The center point of the central hole 101*b* of the soft sheet 101 and the center point of the hollow hole 102*b* of the nozzle plate 102 are on the same axis. The chamber frame 103 is disposed on the nozzle plate 102. The actuator body 104 is formed by sequentially stacking, from bottom to top, a piezoelectric carrier plate 104*a*, an adjusting resonance plate 104*b*, and a piezoelectric plate 104*c* with each other. The actuator body 104 is disposed on the chamber frame 103. The piezoelectric carrier plate 104*a* is used to be applied with a first voltage and a second voltage so as to drive the piezoelectric plate 104*c* to bend and vibrate reciprocatingly. The first voltage and the second voltage are alternately applied to the piezoelectric carrier plate 104*a* at a certain frequency. The first voltage and the second voltage may be the positive electrode and the negative electrode of the same power system (not shown), respectively, but is not limited thereto. In some embodiments, the waveform of the power system of the first voltage or the second voltage can also be adjusted according to the design requirements (such as sine wave, pulse wave, square wave, sawtooth wave, etc.). In this embodiment, the first voltage is +5V square wave, and the second voltage is −5V square wave. The alternating frequency between the first voltage and the second voltage is 25 Hz-29 kHz, but is not limited thereto.

In other embodiments of the present disclosure, the waveform of the power system, the voltage value, and the alternating frequency between the first voltage and the second voltage can also be adjusted according to design requirements. The insulation frame 105 is disposed on the actuator body 104. The conductive frame 106 is disposed on the insulation frame 105.

It should be noted that, in this embodiment, when the piezoelectric carrier plate 104*a* is applied with the first voltage and the conductive frame 106 is applied with the second voltage, the piezoelectric plate 104*c* bends and vibrates toward a first direction. While the piezoelectric carrier plate 104*a* is applied with the second voltage and the conductive frame 106 is applied with the first voltage, the piezoelectric plate 104*c* bends and vibrates toward a second direction opposite to the first direction. In this embodiment, the first direction may be upward, and the second direction opposite to the first direction may be downward, but is not limited thereto. In other embodiments of the present disclosure, the first direction and the second direction may refer to other pairs of relative directions, such as up and down, right and left, or back and forward.

It should be noted that, in this embodiment, a resonance chamber 107 is formed among the actuator body 104, the chamber frame 103, and the suspension portion 102*a*. Upon the application of the first voltage and the second voltage alternately, the actuator body 104 is driven and thus brings the nozzle plate 102 to resonate. Accordingly, the suspension portion 102*a* of the nozzle plate 102 bends and vibrates reciprocatingly, by which the gas is pushed through the central hole 101*b* of the soft sheet 101 and the hollow hole 102*b* of the nozzle plate 102 to the resonance chamber 107 and then is discharged out, thereby achieving a gas transmission.

Figure 2A:
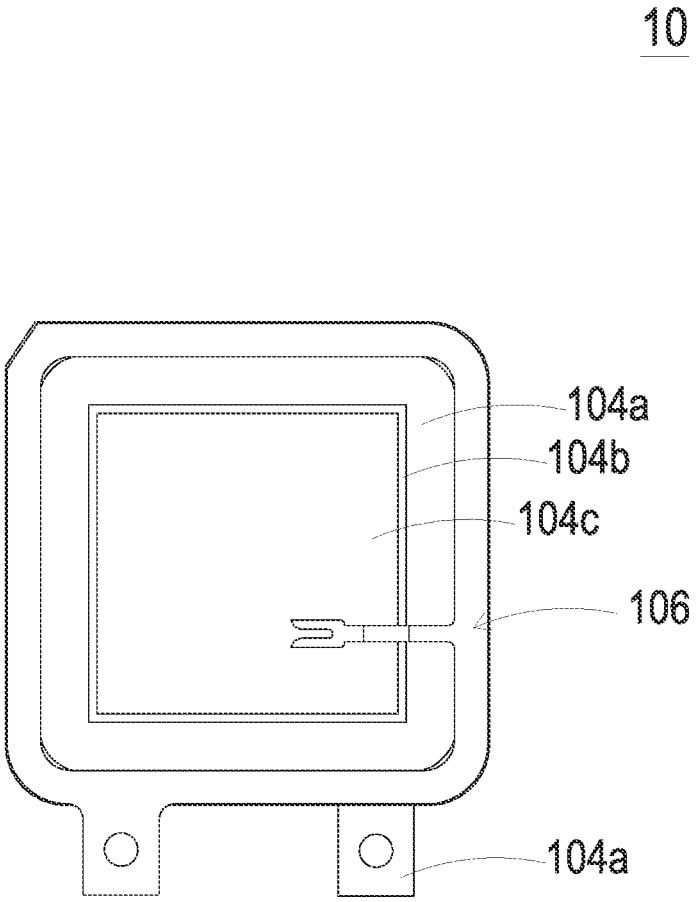
FIG. 2A illustrates a schematic top view of the miniature blower according to the exemplary embodiment of the present disclosure.
Figure 2B:
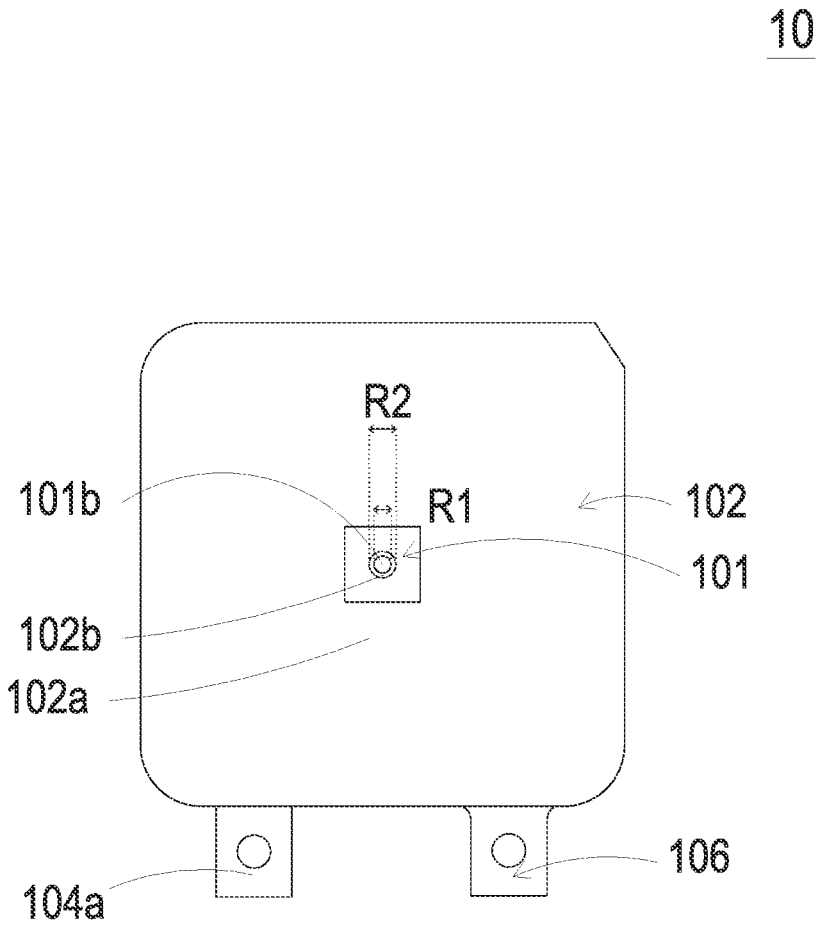
FIG. 2B illustrates a schematic bottom view of the miniature blower according to the exemplary embodiment of the present disclosure.
Figure 3A:
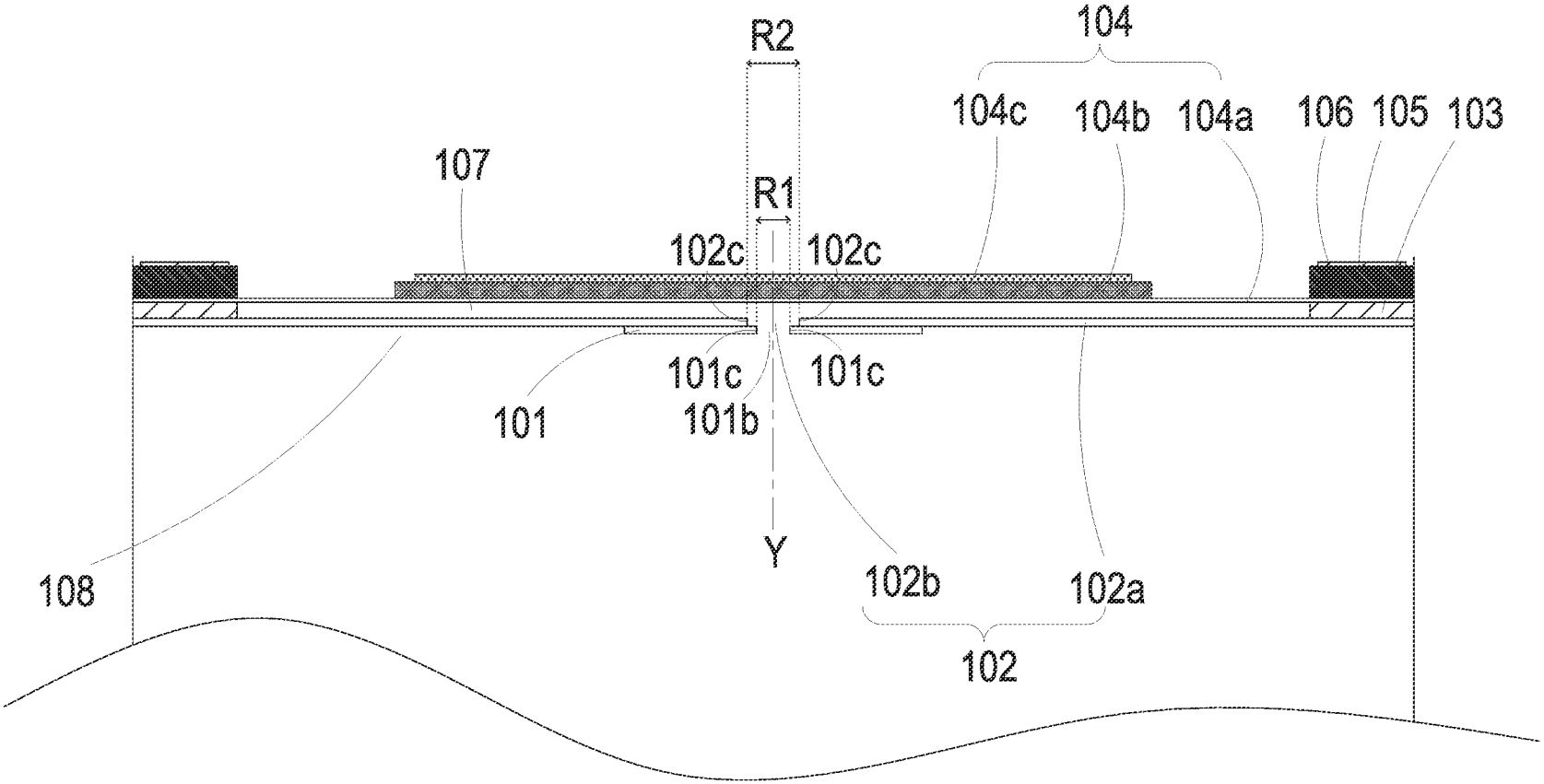
FIG. 3A to FIG. 3D illustrate schematic cross-sectional views showing the miniature blower at different operation steps.

Please refer to FIG. 2B and FIG. 3A. In this embodiment, the central hole 101*b* of the soft sheet 101 has a central hole diameter R1, and the hollow hole 102*b* of the nozzle plate 102 has a hollow hole diameter R2. The central hole diameter R1 is less than the hollow hole diameter R2. It should be noted that, since FIG. 2B illustrates a schematic bottom view of the miniature blower according to the exemplary embodiment of the present disclosure, the periphery of the hollow hole 102*b* (i.e. the periphery that defines the hollow hole diameter R2) should not be seen in FIG. 2B theoretically. However, the periphery of the hollow hole 102*b* is shown in a dotted line for the purpose of comparing the size between the hollow hole diameter R2 and the central hole diameter R1, as shown in FIG. 2B. More specifically, as shown in FIG. 3A, assume there is an axis Y passing through the central hole 101*b*. When the soft sheet 101 is assembled to the suspension portion 102*a*, the soft sheet 101 is staked on the suspension portion 102*a* along the direction of the axis Y, and the central hole 101*b* of the soft sheet 101 aims at the hollow hole 102*b* of the suspension portion 102*a*. In an embodiment, the axis Y is perpendicular to both the soft sheet 101 and the suspension portion 102*a*, and thus penetrates the central hole 101*b* and the hollow hole 102*b* thereof, respectively. Therefore, after the soft sheet 101 and the suspension portion 102*a* are stacked with each other, the center point of the central hole 101*b* and the center point of the hollow hole 102*b* are on the same axis (i.e. the axis Y). In some embodiments, the central hole 101*b* is located at the center of the soft sheet 101, and the hollow hole 102*b* is located at the center of the suspension portion 102*a*. The center point of the central hole 101*b* and the center point of the hollow hole 102*b* are on the same axis. In some embodiments, the central hole 101*b* is not located at the center of the soft sheet 101, but the hollow hole 102*b* is located at the center of the suspension portion 102*a*. However, the center point of the central hole 101*b* and the center point of the hollow hole 102*b* are still on the same axis. In some embodiments, the central hole 101*b* is located at the center of the soft sheet 101, but the hollow hole 102*b* is not located at the center of the suspension portion 102*a*. However, the center point of the central hole 101*b* and the center point of the hollow hole 102*b* are still on the same axis. In some embodiments, the central hole 101*b* is not located at the center of the soft sheet 101, and the hollow hole 102*b* is not located at the center of the suspension portion 102*a*. However, the center point of the central hole 101*b* and the center point of the hollow hole 102*b* are still on the same axis. Moreover, the periphery of the central hole 101*b* is surrounded by a sidewall 101*c*, and the periphery of the hollow hole 102*b* is surrounded by a sidewall 102*c*. Since the hollow hole diameter R2 is greater than the central hole diameter R1, the sidewall 101*c* extends toward the center point of the central hole 101*b* and covers a portion of the hollow hole 102*b*. In some embodiments, the sidewall 101*c* is substantially parallel to the sidewall 102*c*.

It should be noted that, in some other embodiments, as long as the hardness of the soft sheet 101 is less than the hardness of the suspension portion 102*a*, it falls in the scope of the present disclosure. That is, the hardness of the soft sheet 101 being less than the hardness of the suspension portion 102*a* is within the scope of the present disclosure.

It should be noted that, in some other embodiments, as long as the flexural strength of the soft sheet 101 is greater than the flexural strength of the suspension portion 102*a*, it falls in the scope of the present disclosure. That is, the flexural strength of the soft sheet 101 being greater than the flexural strength of the suspension portion 102*a* is within the scope of the present disclosure.

It should be noted that, in some other embodiments, as long as the elasticity of the soft sheet 101 is greater than the elasticity of the suspension portion 102*a*, it falls in the scope of the present disclosure. That is, the elasticity of the soft sheet 101 being greater than the elasticity of the suspension portion 102*a* is within the scope of the present disclosure.

Moreover, it should be noted that, in this embodiment, the central hole 101*b* of the soft sheet 101 has a central hole diameter R1. The central hole diameter R1 is between 0.1 and 0.14 mm. The hollow hole 102*b* of the nozzle plate 102 has a hollow hole diameter R2. The hollow hole diameter is between 0.4 mm and 2.0 mm.

It should be noted that, in this embodiment, the central hole 101*b* of the soft sheet 101 is circular. The central hole 101*b* of the soft sheet 101 may be square-shaped, rhombus-shaped, or parallelogram-shaped as well. The width of the central hole 101*b* is between 0.1 and 0.14 mm, but is not limited thereto. The shape and width of the central hole 101*b* of the soft sheet 101 may be changed according to actual design requirements.

Moreover, it should be noted that, in this embodiment, the hollow hole 102*b* of the nozzle plate 102 is circular. The hollow hole 102*b* of the nozzle plate 102 may be square-shaped, rhombus-shaped, or parallelogram-shaped as well. The width of the hollow hole 102*b* is between 0.4 mm and 2.0 mm, but is not limited thereto. The shape and width of the hollow hole 102*b* of the nozzle plate 102 can be changed according to actual design requirements.

Figure 3B:
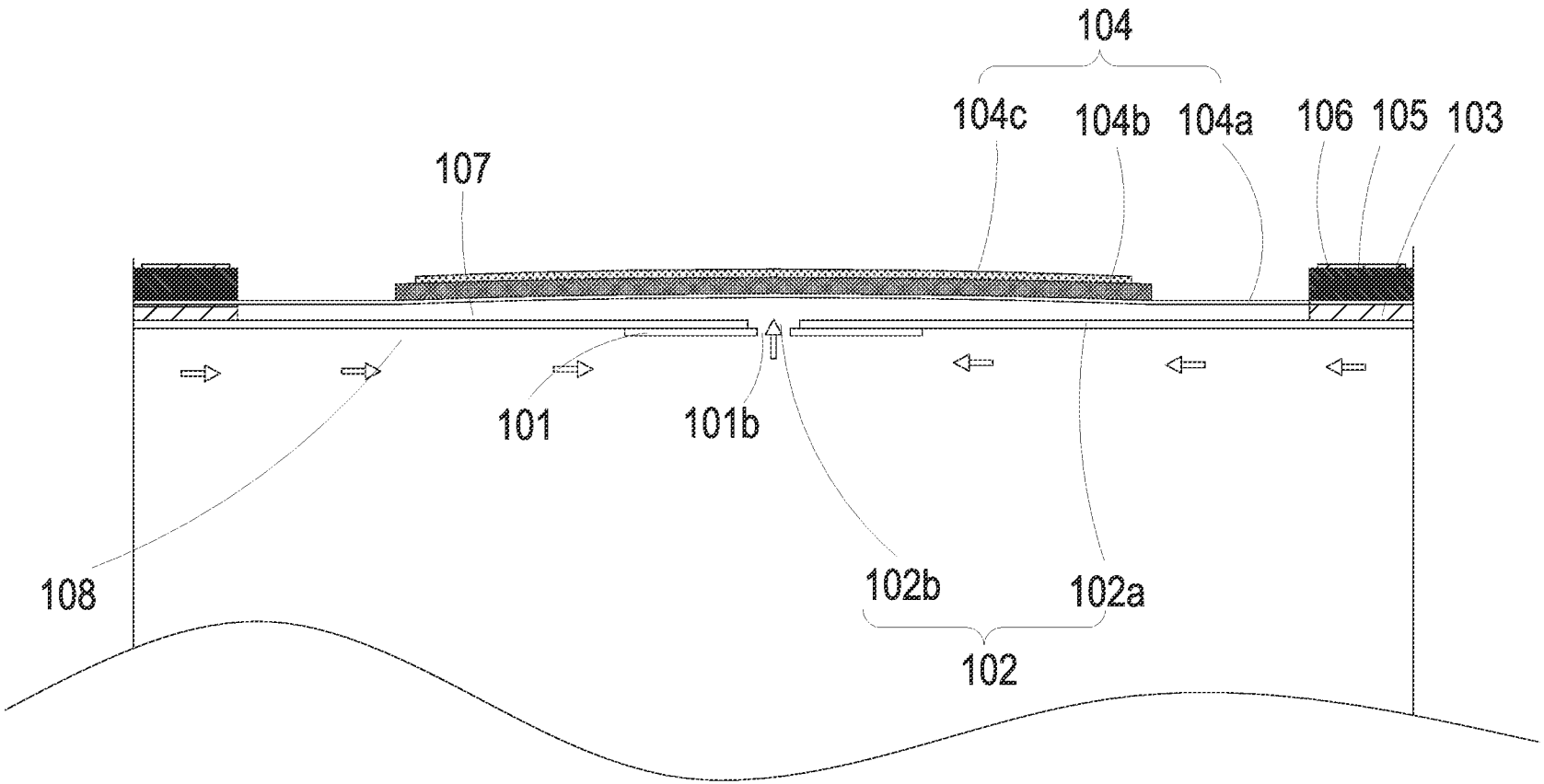
Figure 3C:
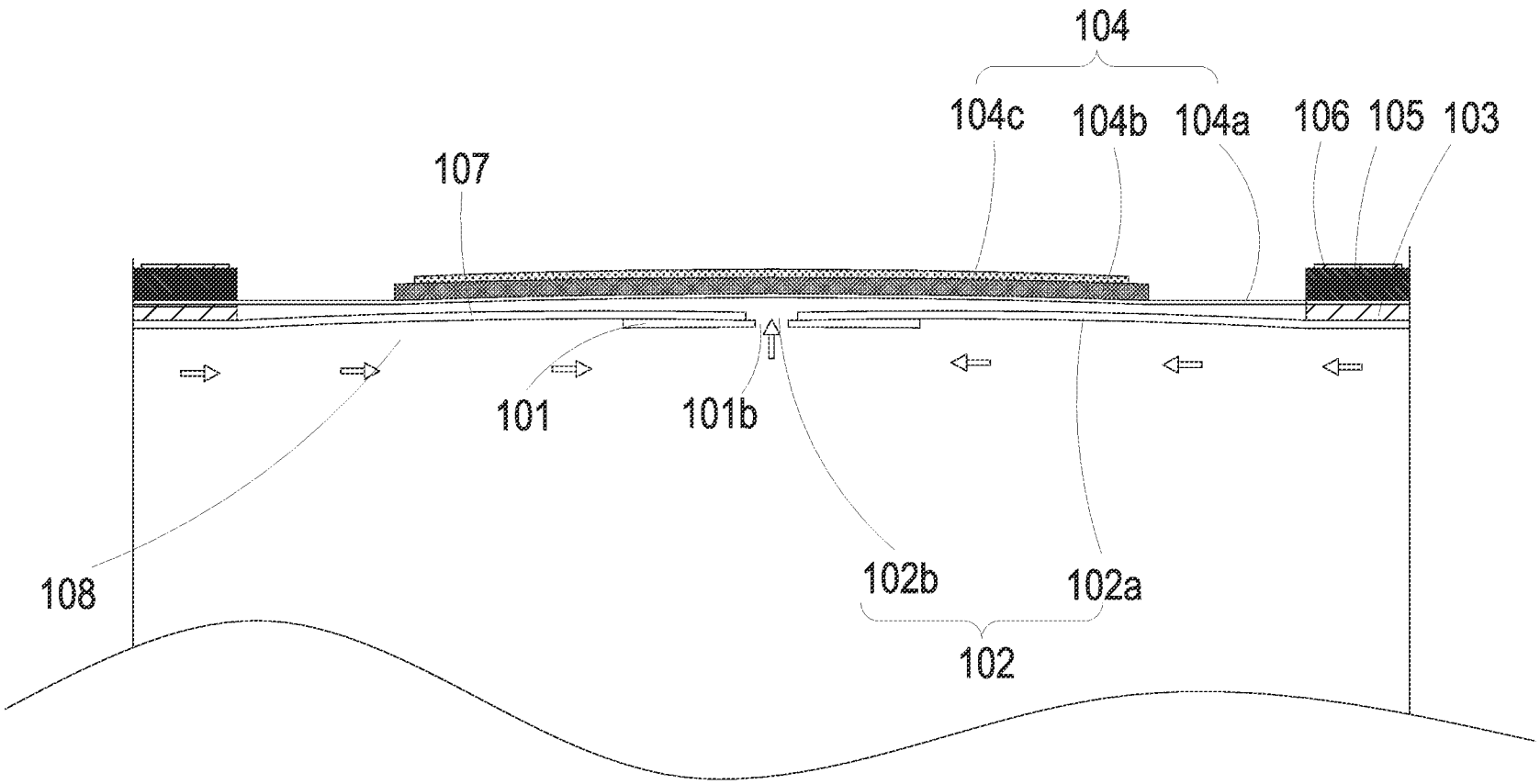
Figure 3D:
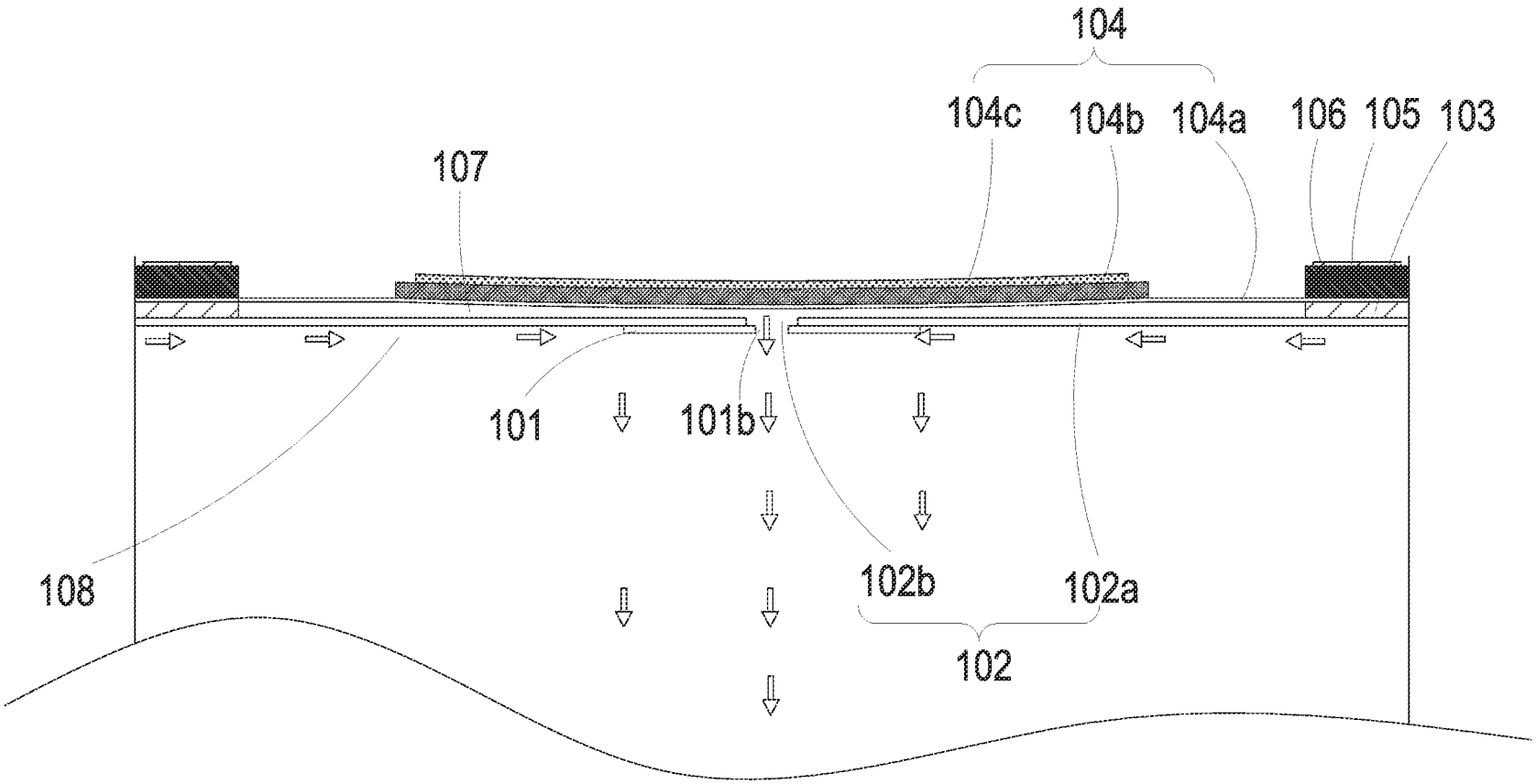

Then, please refer to FIG. 3B to FIG. 3D. FIG. 3B to FIG. 3D illustrate schematic cross-sectional views showing the miniature blower 10 at different operation steps. First, when the actuator body 104 is applied with the first voltage and the conductive frame 106 is applied with the second voltage, the actuator body 104 bends and vibrates toward a first direction. The actuator body 104 is formed by sequentially stacking, from bottom to top, a piezoelectric carrier plate 104*a*, an adjusting resonance plate 104*b*, and a piezoelectric plate 104*c* with each other. As shown in FIG. 3B, when the actuator body 104 bends and vibrates toward a first direction, the internal pressure of the resonance chamber 107 becomes negative, so that the gas enters into the resonance chamber 107 through the central hole 101*b* of the soft sheet 101 and the hollow hole 102*b* of the nozzle plate 102.

Afterwards, due to the sudden negative pressure in the resonance chamber 107, the nozzle plate 102 is driven by the actuator body 104, so that the nozzle plate 102 resonates with the actuator body 104 (as shown in FIG. 3C). When the actuator body 104 is applied with the second voltage and the conductive frame 106 is applied with the first voltage, the piezoelectric plate 104*c* bends and vibrates toward a second direction opposite to the first direction (as shown in FIG. 3D). At this moment, the internal pressure of the resonance chamber 107 becomes positive, so that the gas is discharged out from the resonance chamber 107 to a gas flow chamber 108 through the hollow hole 102*b* of the nozzle plate 102 and the central hole 101*b* of the soft sheet 101.

When the piezoelectric carrier plate 104*a* of the actuator body 104 and the conductive frame 106 are respectively applied with the first voltage and the second voltage alternately at a high frequency, the gas is continuously drawn into the miniature blower and discharged out of the miniature blower through the hollow hole 102*b* of the nozzle plate 102 and the central hole 101*b* of the soft sheet 101. Moreover, the discharged gas will follow Bernoulli's principle, so that the gas in the gas flow chamber 108 flows in the direction indicated by the arrow shown in the FIG. 3D.

Moreover, comparing to the miniature blower without the soft sheet 101, the flow rate of the miniature blower 10 in the present disclosure is raised from 150 ml/s to 200 ml/s, and the decibels of the noise caused by gas flow in physical phenomena is decreased from 50 dB (the decibel of the noise produced by the miniature blower without the soft sheet 101) to 30 dB or lower.

To sum up, the miniature blower of one or some embodiments of the present disclosure can effectively decrease the noise caused by the gas flow. By utilizing specific combination of the hardness, flexural strength, and/or elasticity between the soft sheet and the suspension portion, and the difference between the diameter of the central hole and the diameter of the hollow hole, a miniature blower which is silent and produces stronger Bernoulli effect can be obtained. Thus, the industrial value of the miniature blower is quite high.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A miniature blower, comprising:

a soft sheet having a central hole, wherein the soft sheet is a thin noise-absorbing pad;

a nozzle plate having a suspension portion disposed on the soft sheet, wherein the suspension portion has a hollow hole and is capable of bending and vibrating, and wherein a center point of the central hole of the soft sheet and a center point of the hollow hole of the suspension portion are on a same axis; and wherein the soft sheet does not fully cover the nozzle plate;

a chamber frame disposed on the nozzle plate;

an actuator body formed by sequentially stacking, from bottom to top, a piezoelectric carrier plate, an adjusting resonance plate, and a piezoelectric plate with each other, wherein the actuator body is disposed on the chamber frame, wherein the piezoelectric carrier plate is configured to be applied with a first voltage and a second voltage so as to drive the piezoelectric plate to bend and vibrate reciprocatingly, and wherein the first voltage and the second voltage are alternately applied to the piezoelectric carrier plate at a frequency;

an insulation frame disposed on the actuator body; and a conductive frame disposed on the insulation frame;

wherein when the piezoelectric carrier plate is applied with the first voltage and the conductive frame is applied with the second voltage, the piezoelectric plate bends and vibrates toward a first direction, and when the piezoelectric carrier plate is applied with the second voltage and the conductive frame is applied with the first voltage, the piezoelectric plate bends and vibrates toward a second direction opposite to the first direction, and wherein a resonance chamber is formed among the actuator body, the chamber frame, and the suspension portion, and upon application of the first voltage and the second voltage alternately, the actuator body is driven and thus brings the nozzle plate to resonate, so that the suspension portion of the nozzle plate bends and vibrates reciprocatingly, whereby gas passes through the central hole of the soft sheet and the hollow hole of the suspension portion to the resonance chamber and then is discharged out;

wherein the central hole of the soft sheet has a central hole diameter, and the central hole diameter is between 0.1 and 0.14 mm; wherein the hollow hole of the suspension portion has a hollow hole diameter, and the hollow hole diameter is between 0.4 mm and 2.00 mm; wherein a hardness of the soft sheet is less than a hardness of the suspension portion; wherein a flexural strength of the soft sheet is greater than a flexural strength of the suspension portion; wherein an elasticity of the soft sheet is greater than an elasticity of the suspension portion; and wherein when the miniature blower is operated, a flow rate of the miniature blower is capable of reaching 200 ml/s; while a noise of the miniature blower is 30 dB or lower.

2. The miniature blower according to claim 1, wherein the central hole of the soft sheet has a central hole diameter, and the hollow hole of the suspension portion has a hollow hole diameter, wherein the central hole diameter is less than the hollow hole diameter.

3. The miniature blower according to claim 1, wherein the central hole of the soft sheet is circular.

4. The miniature blower according to claim 1, wherein the central hole of the soft sheet is square-shaped, rhombus-shaped, or parallelogram-shaped.

5. The miniature blower according to claim 1, wherein the hollow hole of the suspension portion is circular.

6. The miniature blower according to claim 1, wherein the hollow hole of the suspension portion is square-shaped, rhombus-shaped, or parallelogram-shaped.

7. The miniature blower according to claim 1, wherein the central hole of the soft sheet has a central hole width, and the central hole width is between 0.1 and 0.14 mm.

8. The miniature blower according to claim 1, wherein the hollow hole of the suspension portion has a hollow hole width, and the hollow hole width is between 0.4 mm and 2.0 mm.

* * * * *